United States Patent [19]

Baba et al.

[11] Patent Number: 4,885,999

[45] Date of Patent: Dec. 12, 1989

[54] PULVERIZED COAL FIRING METHOD AND EQUIPMENT THEREFOR

[75] Inventors: Akira Baba; Kunio Okiura, both of Kure; Naoki Fujiwara, Kawasaki, all of Japan

[73] Assignee: Babcock-Hitachi Kabushiki Kaisha, Tokyo, Japan

[21] Appl. No.: 188,390

[22] PCT Filed: Oct. 15, 1987

[86] PCT No.: PCT/JP87/00784

§ 371 Date: Apr. 20, 1988

§ 102(e) Date: Apr. 20, 1988

[87] PCT Pub. No.: WO88/02833

PCT Pub. Date: Apr. 21, 1988

[30] Foreign Application Priority Data

Oct. 18, 1986 [JP] Japan ..... 61-248101

[51] Int. Cl.[4] ..... F23N 5/18

[52] U.S. Cl. ..... 110/186; 110/232; 110/347

[58] Field of Search ..... 110/232, 347, 263, 264, 110/186

[56] References Cited

U.S. PATENT DOCUMENTS

| | | | |
|---|---|---|---|
| 4,419,941 | 12/1983 | Santalla | 110/347 X |
| 4,436,038 | 3/1984 | Leikert et al. | 110/347 |
| 4,501,206 | 2/1985 | Leikert | 110/347 |
| 4,552,076 | 11/1985 | McCartney | 110/232 X |
| 4,621,582 | 11/1986 | Cooper | 110/347 X |

*Primary Examiner*—Edward G. Favors

*Attorney, Agent, or Firm*—Antonelli, Terry & Wands

[57] ABSTRACT

The invention relates to a method of and an equipment for firing pulverized coal, and is suitable when applied to pulverized coal burning boilers or the like. In a conventional pulverized coal burning boiler, it is impossible to directly ignite the pulverized coal by an igniter, because the pulverized coal concentration in pulverized coal-air mixture fed to burner sections (20) at the early stage of the start-up is low. By this reason, precombustion due to auxiliary fuel such as oil or the like is necessary, and there is a danger of explosion within a furnace. In the invention, the mixture is circulated through a circulation passage (52, 56, 55), thereby raising the pulverized coal concentration in the mixture fed to the burner sections (20) at the start-up, to a level equal to or higher than a stable ignition concentration. Thus, the pulverized coal can easily be burnt without the use of the precombustion due to auxiliary fuel such as oil or the like, and there is also no danger of explosion within the furnace.

11 Claims, 3 Drawing Sheets

PULVERIZED COAL FIRING METHOD AND EQUIPMENT THEREFOR

BACKGROUND OF THE INVENTION

The present invention relates to a pulverized coal firing method and an equipment therefor and, more particularly, to a method of and an equipment for firing pulverized coal carried by combustion air.

Recently, because of a rise in oil fuel prices, a demand for equipment utilizing coal as fuel such as, for example, pulverized coal burning boilers has increased.

In a conventional pulverized coal burning boiler, coal is ground by a mill into pulverized coal, and the pulverized coal is carried by combustion air into a furnace of the boiler and is combusted therewithin. At the early stage of transportation of the pulverized coal, the pulverized coal is no sufficiently formed within the mill and, therefore, an amount of the pulverized coal fed into the furnace, that is, an amount of the pulverized coal with respect to combustion air (a so-called pulverized coal concentration C/A) is low. In addition, at the early stage of operation of the boiler, it is impossible from the viewpoint of safety countermeasure of the boiler to abruptly raise the concentration C/A. Moreover, in order to stably ignite the pulverized coal within the furnace, it is necessary to raise the temperature within the furnace to a level equal to or higher than a given stable ignition temperature (about 500° C.). To this end, in the conventional pulverized coal burning boiler, light oil and/or heavy oil having an ignition temperature lower than that of the coal is combusted at the start-up to burn the pulverized coal of a low concentration and to raise the temperature within the furnace.

In a large-sized boiler, however, several hours are spent in burning the oil at the start-up, so that an excessive amount of oil is consumed.

In view of the above, various measures have been taken to reduce the amount of consumption of the oil at the start-up of the boiler. One of the measures is a so-called bin system disclosed in, for example, JP-U-61-144332, in which pulverized coal is pre-beforehand stored in a pulverized coal storage bin. In the system of this kind, the pulverized coal is fed, at the start-up of the boiler, from the bin into a furnace through a burner device. From the viewpoint of safety countermeasure, however, the bin cannot be arranged in the vicinity of the furnace. In addition, in case of a large-sized boiler for power plant or the like, a line connecting a mill and a burner device is extremely large in diameter. For this reason, it takes a considerable time until pulverized coal and transporting air are sufficiently mixed with each other, and the mixture is sufficiently raised in concentration and is fed into a furnace. Accordingly, the mixture containing the pulverized coal is fed into the furnace without being burned, resulting in an ignition lag. This causes a danger that as combustion is actually initiated, pressure within the furnace rises abnormally, and explosion due to unburnt pulverized coal occurs within the furnace. Furthermore, it has been difficult to remarkably lower an amount of consumption of oil. Systems of this kind are disclosed, for example, in JP-Y2-62-34127, JP-A-59-95310, JP-A-5974423, JP-A-59-24118, JP-A-57-104026 and so on.

Additionally, in recent years, start-up and suspension tend to frequently be carried out in boilers for the power plant thereby resulting in an increase in an amount of consumption of oil.

In equipment of the aforementioned type, it is impossible to directly ignite pulverized coal, because the pulverized coal fed at the start-up is low in concentration. Accordingly, it has been necessary to burn auxiliary fuel such as oil or the like to ignite the pulverized coal.

It is, therefore, an object of the invention to provide a pulverized coal firing method and an equipment therefor which can directly ignite pulverized coal without the use of auxiliary fuel.

In order to achieve the object, according to the invention, mixture gas of pulverized coal and combustion air is fed to a burner device when a pulverized coal concentration of the mixture gas reaches a level equal to or higher than a stable ignition concentration.

Since, according to the invention, it is possible to directly ignite the pulverized coal, the necessity of using auxiliary fuel such as oil or the like is dispensed with. Since the necessity of using oil higher in price than coal is dispensed with, it is possible to reduce the running cost of the equipment. In particular, when the invention is applied to boilers in which a middle load operation is carried out, extremely high effects are offered. In addition, if there is no necessity of using oil, an oil tank and oil feed lines employed in the prior art are dispensed with. This makes it possible also to reduce the initial cost such as the cost of equipment or the like.

Moreover, since the pulverized coal fed to burner sections is immediately combusted, the uncombusted pulverized coal is prevented from being accumulated within the furnace, so that a danger of explosion within the furnace is eliminated, making it possible to prevent an abnormal rise in pressure within the furnace.

DETAILED DESCRIPTION OF PREFERRED EMBODIMENTS

Figure 1:
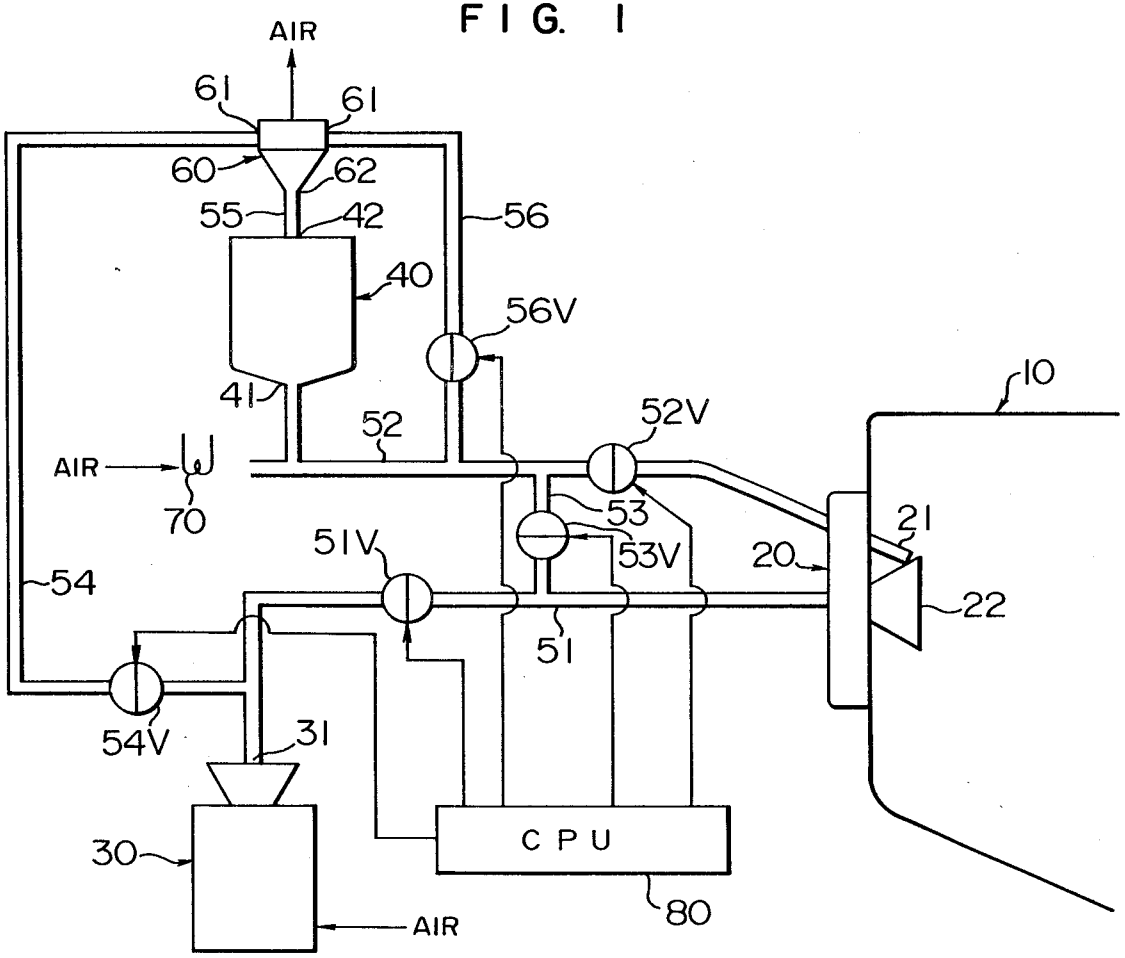
FIG. 1 is a schematic pipe diagram showing an arrangement of a pulverized coal burning boiler to which an embodiment of the invention is applied.

Referring now to the drawings wherein like reference numerals are used throughout the various views to designate like parts and, more particularly, to FIG. 1, according to this figure, a pulverized coal burning boiler comprises a furnace generally designated by the reference numeral 10, a plurality of burner sections generally designated by the reference numeral 20 (only one shown) provided in the furnace 10, a mill generally designated by the reference numeral 30, and a pulverized coal storage bin 40. Each of the burner sections 20 has a pilot burner 21 and a start-up and main burner 22. An outlet 31 of the mill 30 and the start-up and main burner 22 communicate with each other through a pulverized coal main feed line 51 which is provided a midway thereof with a shut-off valve 51V. The pulverized coal ground by the mill 30 is fed toward the start-up and main burner 22 by transporting air through the pulverized coal main feed line 51. An outlet 41 of the bin 40 is communicated with the pilot burner 21 through a pulverized coal feed line 52 which is provided at a midway thereof with a shut-off valve 52V. A portion of the pulverized coal feed line 52 between the bin 40 and the shut-off valve 52V and a portion of the pulverized coal main feed line 51 between the shut-off valve 51V and the start-up and main burner 22 communicate with each other through a communication line 53 which is provided at a midway thereof with a shut-off valve 53V.

The outlet 31 of the mill 30 communicates with an inlet 61 of a bag filter 60 thorugh a pulverized coal storage line 54. The bag filter 60 has an outlet 62 which communicates with an inlet 42 of the bin 40 through a communication line 55.

A portion of the pulverized coal feed line 52 between the bin 40 and the shut-off valve 52V and the inlet 61 of the bag filter 60 communicate with each other through a pulverized coal return line 56 having a shutoff valve 56V provided at a midway thereof.

The burner section 20, the mill 30 and the bin 40 are conventional, and the detailed description of operation and arrangement thereof will therefore be omitted. It is needless to say, however, that a metering feeder and an ejector for sealing an air flow from the pulverized coal feed line 52 to the bin 40 are provided at a portion of the pulverized coal feed line 52 in the vicinity of the outlet 41 of the bin 40.

In operation, in advance of the start-up of the boiler, the shut-off valves 51V, 52V and 53V are first brought to their respective closed positions, to close the respective 25 lines 51, 52 and 53. The shut-off valve 56V is brought to its open position.

Subsequently, the mill 30 is driven, and air is blown by a blower, not shown, into the pulverized coal feed line 52. The air is blown while being heated by a heater 70. This causes pulverized coal stored in the bin 40 to flow through the pulverized coal feed line 52. Since, however, the shut-off valves 52V and 53V are in their respective closed positions, the air containing the pulverized coal flows through the pulverized coal return line 56, but does not flow to the burner section. The pulverized coal is collected by the bag filter 60, and the air is discharged to the outside thereof. The pulverized coal collected by the bag filter 60 is returned into the bin 40 through the communication line 55. That is, a pulverized coal circulation passage is formed by a part of the pulverized coal feed line 52, the pulverized coal return line 56 and the communication line 55. The pulverized coal is circulated through the circulation passage, and such circulation is repeated for a while. During such circulation, the transporting air supplements the pulverized coal from the mill 30 to the bin 40 through the bag filter 60. Additionally, a shut-off valve 54V is provided in the pulverized coal storage line 54. This shut-off valve 54V is in its open position during storage of the pulverized coal in the bin 40, and in a closed position during circulation of the pulverized coal and during supply of the pulverized coal to the burner section.

After a predetermined time elapses from the start-up, it is judged that a concentration C/A of the pulverized coal flowing through the pulverized coal circulation passage reaches a level required for stable ignition. A CPU 80 issues commands to switch over the shut-off valves 52V and 56V to open and closed positions, respectively. This shuts off the circulation passage, so that the pulverized coal from the bin 40 is fed to the pilot burner 21 through the pulverized coal feed line 52. The pulverized coal in the pulverized coal feed line 52 has a pulverized coal concentration C/A reaching a sufficient level, and is uniformly mixed. Further, since the combustion air is heated to a predetermined temperature, the pulverized coal in the pulverized coal feed line 52 is easily ignited by an igniter. Subsequently, the shut-off valve 53V is switched over to its open position. This causes the pulverized coal from the bin 40 to be fed to the start-up and main burner 22 through a part of the pulverized coal feed line 52, the communication line 53 and a part of the pulverized coal main feed line 51, so that the pulverized coal is ignited by the pilot burner 21. Thereafter, the shut-off valves 52V and 51V are switched over to closed and open positions, respectively. This causes the pulverized coal from the mill 30 to be fed to the start-up and main burner 22 through the pulverized coal main feed line 51, so that the pulverized coal is burnt. Subsequently, the shut-off valve 53V is switched over to its closed position. The above-described switching of the valves may be effected by manual operation due to an operator.

Figure 3:
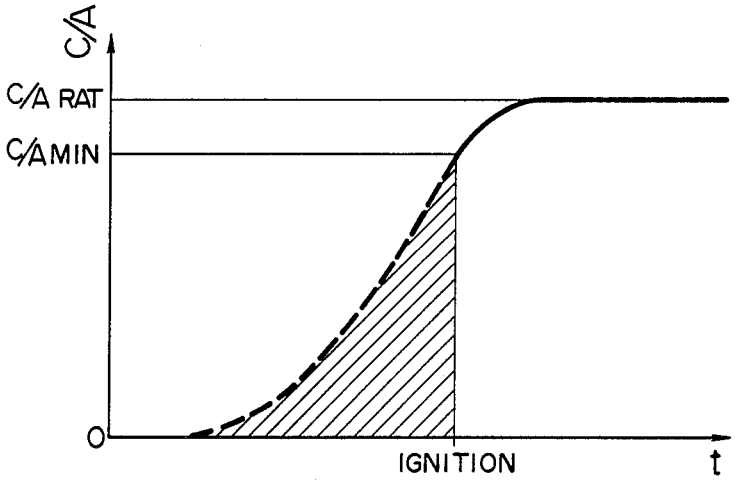
FIG. 3 is a graphical illustration depicting a change in concentration of pulverized coal with an elapse of time.
Figure 4:
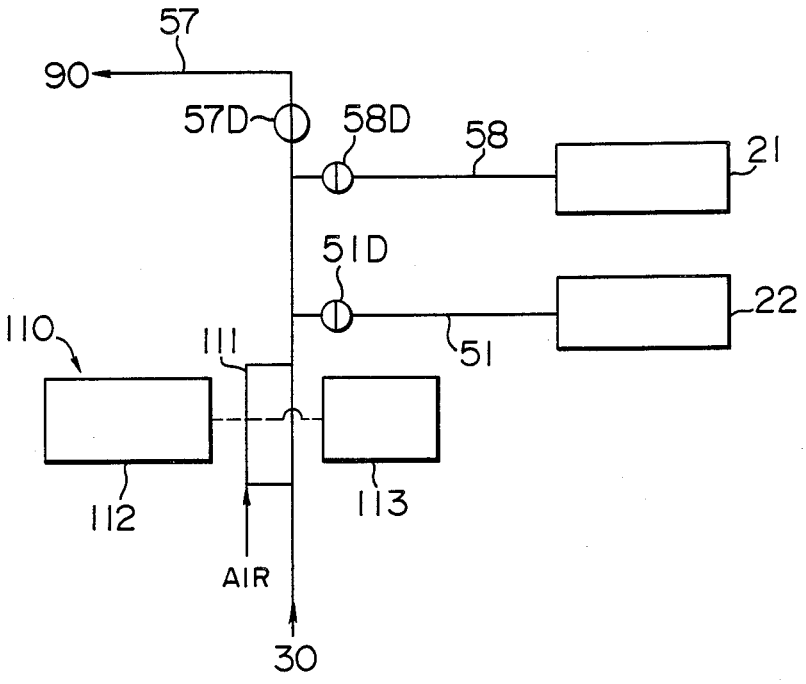

The above operation can be represented by a change in pulverized coal concentration with an elapse of time. The broken line in FIG. 3 indicates a change in concentration of the pulverized coal flowing from the bin 40 toward the burner device after the start-up of the boiler. The concentration C/A of the pulverized coal from the bin 40 increases with an elapse of time, and the pulverized coal is ignited by the igniter when the concentration reaches a level of C/A min which is the lowest pulverized coal concentration required for ignition. In the meantime, the pulverized coal corresponding to a shaded portion in FIG. 7 is circulated through the circulation passage. After ignition, the pulverized coal concentration further increases, and reaches a level of a pulverized coal concentration C/A rat for a rated operation, so that steady combustion is done.

In the embodiment described above, the judgment as to whether the pulverized coal concentration C/A reaches the stable ignition concentration is carried out on the basis of the elapsed time. Alternatively, however, the concentration of the pulverized coal flowing through the circulation passage may directly be measured by optically measuring means. For example, laser beam emitting and receiving units may be employed to measure the pulverized coal concentration, based on absorption of the laser beam by the pulverized coal, that is, transmittance of the laser beam. Additionally, other various measuring means can be employed.

The communication line 53 and the shut-off valve 53V are not necessarily required. If the pilot burner 21 has a capacity sufficient to stably ignite the start-up and main burner 22, the shut-off valve 51V is switched over to its open position so that the pulverized coal can directly be fed from the mill 30 to the start-up and main burner 22 and be ignited thereby, instead of feeding the pulverized coal from the bin 40 to the start-up and main burner 22 through the communication line 53. In this case, the entire equipment is further simplified in construction.

Figure 2:
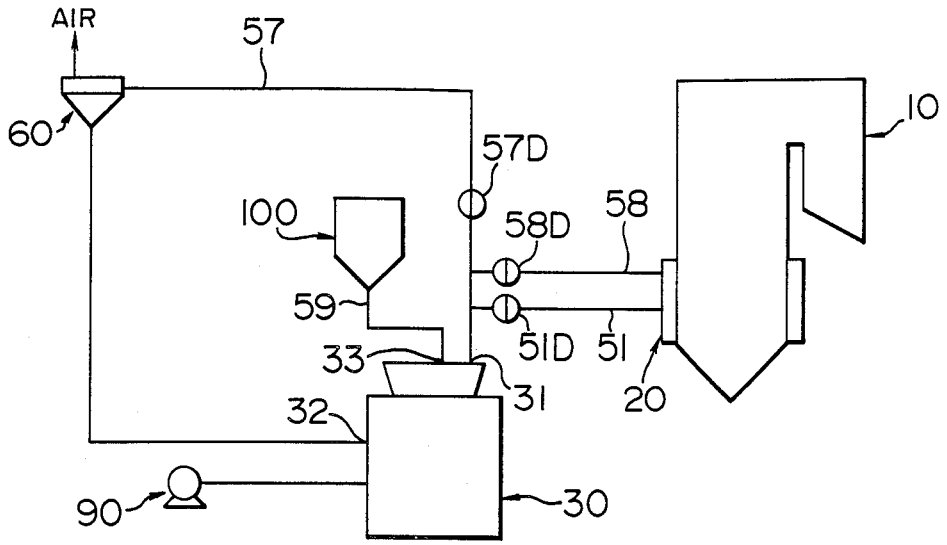
FIGS. 2 and 4 are schematic pipe diagrams respectively showing arrangements of pulverized coal burning boilers to which other embodiments of the invention are applied respectively.

In another pulverized coal burning boiler shown in FIG. 2, a return line 57 is connected to the outlet 31 of the mill 30. The return line 57 is provided at a midway thereof with a switching damper 57D and the bag filter 60, and is connected to an inlet 32 of the mill 30. A blower 90 for feeding the pulverized coal is connected to an air introducing port of the mill 30. The pulverized coal main feed line 51 having at a midway thereof a switching damper 51D and a pulverized coal feed line 58 having at a midway thereof a switching damper 58D branch from a portion of the return line 57 between the outlet 31 of the mill 30 and the switching damper 57D, respectively. The pulverized coal main feed line 51 is connected to a main burner of the burner section 20, and the pulverized coal feed line 58 is connected to an ignition and start-up burner of the burner section 20.

A bunker generally designated by the reference numeral for feeding fuel coal to the mill 30 connected to a coal introducing port 33 of the mill 30 through a coal distribution line 59.

In operation, switching dampers 51D and 58D are first brought to their closed positions, and the switching damper 57D is brought to its open position. Then, as the mill 30 is started, a mixture containing the pulverized coal of a low concentration is circulated by the blower 90 through the return line 57. Since the pulverized coal is continuously added from the mill 30 into the mixture within the return line 57, the pulverized coal concentration in the mixture increases gradually. As a predetermined time elapses which is determined according to the capacity of the mill 30 or the like, it is judged that the pulverized coal concentration in the mixture within the return line 57 is raised to the stable ignition concentration. The switching damper 57D is switched over to its closed position, and the switching damper 58D is switched over to its open position. The mixture containing the pulverized coal of an adequate concentration is fed to the pilot and start-up burner through the pulverized coal feed line 58, and is ignited and started by the igniter. Subsequently, the switching damper 51D is switched over to its open position, so that the mixture from the mill 30 is fed to the main burner through the pulverized coal main feed line 51 and is burnt.

The pulverized coal burning boiler illustrated in FIG. 2 can be simplified in the entire construction, as compared with that shown in FIG. 1, because the bin and installations associated therewith are dispensed with.

The invention is also applicable to a pulverized coal burning boiler comprising burner sections each of which includes a pilot burner, a start-up burner and a main burner and which burners are connected respectively to separate pulverized coal feed lines, respectively. In addition, in order to assist combustion of the pulverized coal, oil, gas or the like may also be used as auxiliary fuel at the pilot burner and/or the start-up burner.

The invention can be utilized to ignite and/or start pulverized coal burning boilers and the like which employ pulverized coal as fuel.

What is claimed is:

1. A method of firing pulverized coal fed by combustion air, the method comprising the steps of circulating pulverized coal from a mill means in a closed pulverized circuit in advance of a supply of said pulverized coal into a burner means, and feeding a mixture of said pulverized coal and said combustion air to said burner means at a start up, when a concentration of the pulverized coal in said mixture of said pulverized coal and said combustion air reaches a stable ignition concentration.

2. A pulverized coal firing equipment comprising:

a burner means;

pulverized coal supply means for feeding pulverized coal to said burner means, said pulverized coal supply means including a mill means for grinding coal, and pulverized coal feed line means for connecting said mill means to said burner means;

return line means branching from the pulverized coal supply means, through which the pulverized coal is circulated, said mill means being arranged midway in said return line means; and switching means for opening or closing the pulverized coal supply means and for opening or closing the return line means.

3. A pulverized coal firing equipment comprising:

a burner means;

pulverized coal supply means for feeding pulverized coal to said burner means, said pulverized coal supply means comprising a mill means for grinding coal, a pulverized coal main feed line means for connecting said mill means to said burner means, a bin means for storing therein the pulverized coal and being communicated with said mill means, and a pulverized coal feed line means for connecting said bin means to said burner means;

return line means for connecting an upstream side of said pulverized coal feed line means with a downstream side thereof to form a closed pulverized coal circuit including said bin means; and switching means for opening or closing said pulverized coal supply means and for opening or closing said return line means.

4. A pulverized coal firing equipment according to claim 3, further comprising measuring means for measuring a concentration of the pulverized coal within the return line means, and a control means receiving signals from said measuring means representative of said concentration, for switching over said switching means when it is judged that said concentration reaches a stable ignition concentration.

5. A pulverized coal firing equipment according to claim 3, further comprising a control device means for switching over said switching means when a predetermined time elapses from the start-up.

6. A pulverized coal firing equipment as set forth in, claim 2, further comprising measuring means for measuring a concentration of the pulverized coal within the return line means, and a control means for receiving signals from said measuring means representative of said concentration, for switching over said switching means when it is judged that said concentration reaches a stable ignition concentration.

7. A pulverized coal firing equipment as set forth in claim 2, further comprising a control means for switching over said switching means when a predetermined time elapses from the start up.

8. A pulverized coal firing equipment comprising:

a burner means;

pulverized coal supply means for feeding pulverized coal to said burner means;

return line means branching from the pulverized coal supply means, through which the pulverized coal is circulated;

switching means for opening or closing the pulverized coal supply means and for opening or closing the return line means;

measuring means for measuring a concentration of the pulverized coal within the return line means; and a control means for receiving signals from said measuring means representative of said concentration, for switching over said switching means when it is judged that said concentration reaches a stable ignition concentration.

9. A pulverized coal firing equipment comprising:

a burner means;

pulverized coal supply means for feeding pulverized coal to said burner means, said pulverized coal supply means comprising a mill means for grinding coal, a pulverized coal main feed line means for connecting said mill means to said burner means, a bin means for storing therein the pulverized coal, and a pulverized coal feed line means for connecting said bin means to said burner means, said bin means being arranged midway in said return line means; and measuring means for measuring a concentration of the pulverized coal within the return line mean; and a control means receiving signals from said measuring means representative of said concentration, for switching over said switching means when it is judged that it said concentration reaches a stable condition.

10. A pulverized coal firing equipment comprising:

a burner means;

pulverized coal supply means for feeding pulverized coal to said burner means;

return line means branching from the pulverized coal supply means through which the pulverized coal is circulated;

switching means for opening or closing the pulverized coal supply means and for opening or closing the return line means; and a control means for switching over said switching means when a predètermined time elapses from the start up.

11. A pulverized coal firing equipment comprising:

a burner means;

pulverized coal supply means for feeding pulverized coal to said burner, said pulverized coal supply means comprising a mill means for grinding coal, a pulverized coal main feed line means for connecting said mill means to said burner means, a bin means for storing therein the pulverized coal, and a pulverized coal feed line means for connecting said bin means to said burner means, said bin being arranged midway in said return line means;

return line means branching from the pulverized coal supply means through which the pulverized coal is circulated;

switching means for opening or closing the pulverized coal supply means and for opening or closing the return line means; and a control means for switching over said switching when a predetermined time elapses from the start up.

* * * * *